US010039326B2

(12) United States Patent
Wu

(10) Patent No.: US 10,039,326 B2
(45) Date of Patent: Aug. 7, 2018

(54) CERAMIC ATOMIZING WICK AND CIGARETTE CARTRIDGE

(71) Applicant: SHENZHEN SMACO TECHNOLOGY LIMITED, Shenzhen, Guangdong Province (CN)

(72) Inventor: Yangyang Wu, Shenzhen (CN)

(73) Assignee: SHENZHEN SMACO TECHNOLOGY LIMITED, Shenzhen, Guangdong Province (CN)

( * ) Notice: Subject to any disclaimer, the term of this patent is extended or adjusted under 35 U.S.C. 154(b) by 203 days.

(21) Appl. No.: 15/222,915

(22) Filed: Jul. 28, 2016

(65) Prior Publication Data

US 2017/0127723 A1 May 11, 2017

(30) Foreign Application Priority Data

Nov. 5, 2015 (CN) ..... 2015 1 0743946

(51) Int. Cl.
*A24F 47/00* (2006.01)
*B65D 85/00* (2006.01)

(52) U.S. Cl.
CPC ..... *A24F 47/008* (2013.01); *B65D 85/70* (2013.01)

(58) Field of Classification Search
CPC ..... B65D 85/70; B65D 25/005; A24F 47/008; A24F 15/12; A24F 15/18; A24F 15/14; G01F 23/00; H02J 7/0044; H02J 7/0052; H02J 7/0042; H02J 50/10; H02J 7/025; H02J 7/0063; B65B 3/04; G09F 2023/0025
USPC ..... 392/395
See application file for complete search history.

(56) References Cited

U.S. PATENT DOCUMENTS

| | | | | |
|---|---|---|---|---|
| 9,423,152 | B2 * | 8/2016 | Ampolini | A24F 47/008 |
| 9,560,883 | B2 * | 2/2017 | Hawes | A24F 47/008 |
| 9,723,877 | B2 * | 8/2017 | Wong | A24F 47/008 |
| 9,913,493 | B2 * | 3/2018 | Worm | A61M 15/06 |
| 2015/0053217 | A1 * | 2/2015 | Steingraber | A24F 47/008 131/329 |
| 2016/0150824 | A1 * | 6/2016 | Memari | A24F 15/12 131/329 |
| 2016/0366946 | A1 * | 12/2016 | Murison | A24F 15/12 |
| 2017/0043999 | A1 * | 2/2017 | Murison | B67D 7/36 |
| 2017/0045150 | A1 * | 2/2017 | Marsh | A24F 15/18 |
| 2017/0045994 | A1 * | 2/2017 | Murison | A24F 15/18 |
| 2017/0048927 | A1 * | 2/2017 | Murison | A24F 15/18 |

(Continued)

*Primary Examiner* — Eric Stapleton
(74) *Attorney, Agent, or Firm* — Cheng-Ju Chiang

(57) ABSTRACT

The present invention relates to a ceramic atomizing wick. The ceramic atomizing wick comprises a power supply positive terminal, a power supply negative terminal, and a fixing mount. An air inlet is disposed and opened at an outer wall surface of the power supply positive terminal. A threaded hole is disposed and opened along an axial direction of the fixing mount, and a ceramic liquid guiding wick is partially installed in the threaded hole. An inner wall of the ceramic liquid guiding wick is in contact with an atomizing heating piece. The ceramic liquid guiding wick of the present invention is made of porous ceramics to have a characteristic of high-temperature resistance in order for being uneasy to produce scorched pastes thereon. The contact area of the ceramic liquid guiding wick with cigarette liquid is large, and the liquid guiding speed of the ceramic liquid guiding wick is fast.

10 Claims, 2 Drawing Sheets

(56) References Cited

U.S. PATENT DOCUMENTS

| | | | | |
|---|---|---|---|---|
| 2017/0048930 | A1* | 2/2017 | Marsh | A24F 15/18 |
| 2017/0064997 | A1* | 3/2017 | Murison | A24F 15/12 |
| 2017/0099878 | A1* | 4/2017 | Murison | A24F 47/008 |

* cited by examiner

CERAMIC ATOMIZING WICK AND CIGARETTE CARTRIDGE

BACKGROUND OF THE INVENTION

1. Field of the Invention

The present invention relates to an electronic cigarette product, particularly with regard to a ceramic atomizing wick and cigarette cartridge.

2. The Related Arts

Atomizers as a tool for absorbing and sucking cigarette oils are used to atomize traditional liquid cigarette oils for smoking and inhaling. However, traditional atomizers are mainly filled with liquid cigarette oils. Before smoking and inhaling, liquid smoke oils are in the state of liquid and stored in atomizing steel pipes. It is likely to easily result in leakage of liquid cigarette oils and other inconveniences before smoking and inhaling. Moreover, transportation of liquid cigarette oils is very inconvenient. As a result, solid cigarette oils become a developing direction of electronic cigarettes. Electronic cigarettes are a kind of electronic products for imitating real cigarettes by having the same appearance, smoke, taste and feel as real cigarettes. It is a product using atomization and other means to vaporize nicotine and other ingredients for users to suck and inhale.

Currently on the market, electronic cigarette atomizers usually are made to use a heating assembly having a liquid guiding rope made of fiber cotton and twined around a heating wire. The liquid guiding speed of the liquid guiding rope is slow, and when the guide liquid rope lacks of liquid cigarette oils, the liquid guiding rope may sometimes have burnt phenomenon. Besides, the heating area of the heating wire is small, and its producing quantity of smoke is small. Traditional integrated cigarette cartridges are easy to leak cigarette liquids during transportation because the ability of liquid storage of the liquid guiding rope is poorer. Meanwhile, traditional electronic cigarettes have to use metal frames to fix the liquid guiding rope because the liquid guiding rope made of soft material is used to guide liquid cigarette oils, and the contact area of the liquid guiding rope with the cigarette liquid is relatively much small. In addition, the liquid guiding rope made of fiber cotton material is not environmentally friendly and has a short using life. Because the material of the liquid guiding rope is quite softer and is difficult to be used to achieve wholly automatic processing. Hence, the traditional atomizers are difficult to assemble, have complex processing to make, and have an instable quality.

SUMMARY OF THE INVENTION

The main objective of the present invention is to provide a ceramic atomizing wick and cigarette cartridge in order to overcome the above shortcomings of the prior art and existing technology.

The present invention is realized by the following technical solutions. A ceramic atomizing wick of the present invention comprises a power supply positive terminal, a power supply negative terminal, and a fixing mount. An air inlet is disposed and opened at the power supply positive terminal along a direction from an outer wall surface of the power supply positive terminal toward an inner wall surface of the power supply positive terminal. The power supply negative terminal is installed at a lower end of the power supply positive terminal, and an insulation ring is installed between an inner wall of the power supply positive terminal and an outer wall of the power supply negative terminal. A threaded hole is disposed and opened along an axial direction of the fixing mount, and a ceramic liquid guiding wick is partially installed in the threaded hole. An inner wall of the ceramic liquid guiding wick is in contact with an atomizing heating piece.

An outer threaded section is disposed at a lower end of an outer wall of the ceramic liquid guiding wick, and the outer threaded section is installed in the threaded hole of the fixing mount.

A sealing ring is installed between the fixing mount and the power supply positive terminal.

The atomizing heating piece can be heating wires or metal heating films. The heating wire is bent into a spiral shape in order to enlarge a contact area of the heating wire with cigarette liquid and to improve heating efficiency thereof.

The present invention also provides a cigarette cartridge. The cigarette cartridge comprises a cigarette liquid cup, a liquid storage disposed inside the cigarette liquid cup, and an airflow passageway disposed and opened along an axial direction of the cigarette liquid cup. The ceramic atomizing wick is installed in the cigarette liquid cup.

The ceramic liquid guiding wick absorbs and stores the cigarette liquid therein when the present invention is in use. The atomizing heating piece is adhered to the inner wall of the ceramic liquid guiding wick. Air from the air inlet enters an interior of the atomizing wick. After a power supply of the atomizing wick is electrically connected to electrify the atomizing heating piece, the cigarette liquid stored in the ceramic liquid guiding wick is heated and vaporized to produce smokes for users to inhale.

Compared with the prior art and existing technology, beneficial effects of the present invention are:

(1) The ceramic liquid guiding wick is made of porous ceramics. Its porosity rate is 40%-80%, and a caliber of its pores is 10-5000μm. The ceramic liquid guiding wick is characterized by a good absorbency and a good property for liquid storage. High-temperature resistance is a characteristic of ceramics to be uneasy to produce scorched pastes thereon.

(2) Physical properties of the ceramic liquid guiding wick are stable, and the ceramic liquid guiding wick can be assembled directly with the cigarette liquid cup without an additional mounting frame. The contact area of the ceramic liquid guiding wick with the cigarette liquid is large, and the speed of guiding cigarette liquid of the ceramic liquid guiding wick is fast.

(3) The atomizing heating piece is adhered to the inner wall of the liquid guiding wick, and is made as a hollow structure. A middle airflow passageway of the atomizing heating piece is smooth, and the heating area thereof is large so that it can produce a large quantity of smoke.

(4) The structure of the cigarette cartridge of the present invention is simple and is easy to process.

DETAILED DESCRIPTION OF PREFERRED EMBODIMENT

To make objectives, technical solutions and advantages of the present invention much more apparent and explicit, the present invention will be further described in details in combination with attached drawings and embodiments as below. It should be understood that specific physical embodiments described herein are merely used to explain the present invention and are not intended to limit the present invention in any way.

Figure 1:
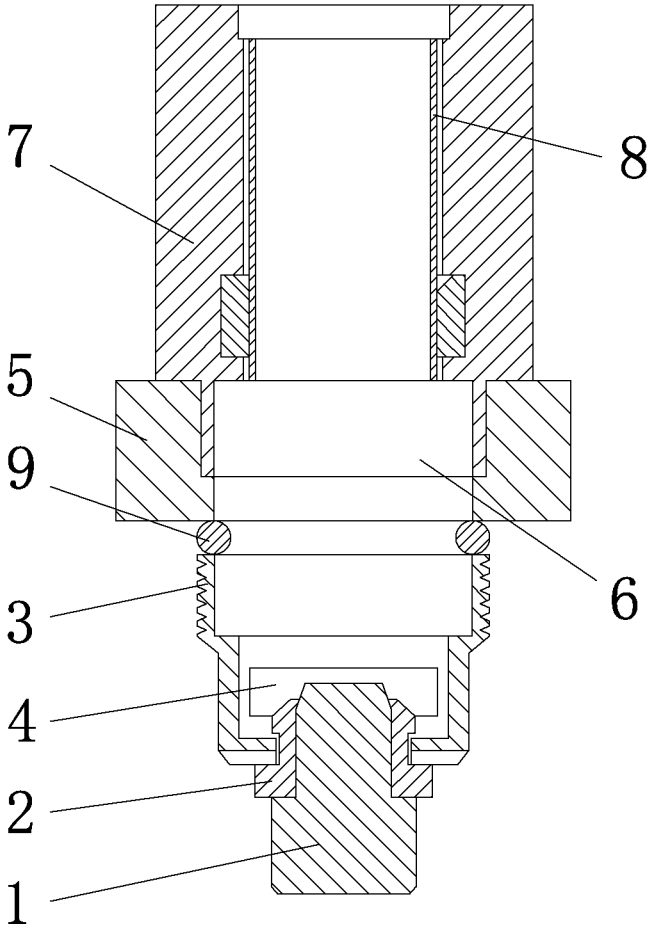
FIG. 1 shows a structural schematic cross sectional view of a ceramic atomizing wick in accordance with the present invention.

With reference to FIG. 1, a ceramic atomizing wick in accordance with the present invention comprises a power supply positive terminal 3, a power supply negative terminal 1, and a fixing mount 5. An air inlet 4 is disposed and opened at the power supply positive terminal 3 along a direction from an outer wall surface of the power supply positive terminal 3 toward an inner wall surface of the power supply positive terminal 3. The power supply negative terminal 1 is installed at a lower end of the power supply positive terminal 3, and an insulation ring 2 is installed between an inner wall of the power supply positive terminal 3 and an outer wall of the power supply negative terminal 1. A threaded hole 6 is disposed and opened along an axial direction of the fixing mount 5, and a ceramic liquid guiding wick 7 is partially installed in the threaded hole 6. An inner wall of the ceramic liquid guiding wick 7 is in contact with an atomizing heating piece 8. An outer threaded section is disposed at a lower end of an outer wall of the ceramic liquid guiding wick 7, and the outer threaded section is installed in the threaded hole 6 of the fixing mount 5. A sealing ring 9 is installed between the fixing mount 5 and the power supply positive terminal 3. The ceramic liquid guiding wick 7 is made of porous ceramics.

The atomizing heating piece 8 can be made of a metal heating film, and the metal heating film is printed on the inner wall of the ceramic liquid guiding wick 7. The metal heating film is gold, silver, copper or other metal materials with good thermal conductivity, and a thickness of the metal heating film is 0.5 μm-50 μm. The atomizing heating piece 8 can also be a spiral heating wire embedded in the ceramic liquid guiding wick 7 in order to increase a contact area of the heating wire with cigarette liquid and to improve heating efficiency thereof.

Figure 2:
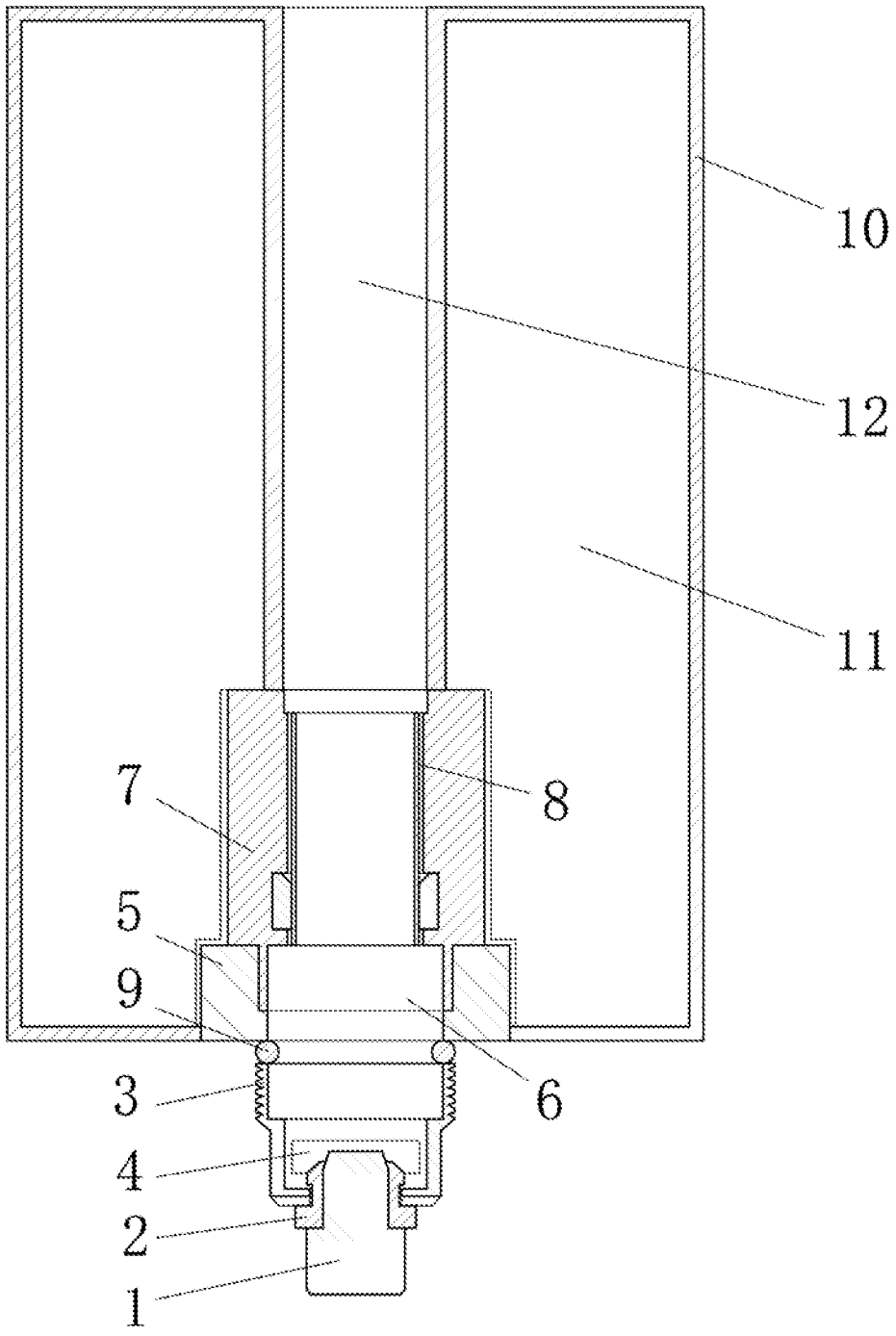
FIG. 2 shows a structural schematic cross sectional view of a cigarette cartridge in accordance with the present invention.

With reference to FIG. 2, a cigarette cartridge in accordance with the present invention comprises a cigarette liquid cup 10, a liquid storage 11 disposed inside the cigarette liquid cup 10, and an airflow passageway 12 disposed and opened along an axial direction of the cigarette liquid cup 10. The ceramic atomizing wick is installed in the cigarette liquid cup 10.

The cigarette cartridge can be either an integrated type cigarette cartridge or a separable type cigarette cartridge.

Furthermore, for the integrated type cigarette cartridge, the atomizing wick is embedded inside the cigarette liquid cup 10. The ceramic liquid guiding wick 7 is in full contact with cigarette liquid stored in the liquid storage 11 in order to absorb and store the cigarette liquid therein. The atomizing heating piece 8 is adhered to the inner wall of the ceramic liquid guiding wick 7. Air from the air inlet 4 enters an interior of the atomizing wick. After a power supply of the atomizing wick is electrically connected to electrify the atomizing heating piece 8, the cigarette liquid stored in the ceramic liquid guiding wick 7 is heated and vaporized to produce smokes for users to inhale through the airflow passageway 12.

The cigarette liquid cup 10 for the separable type cigarette cartridge is a closed structure. In use, the atomizing wick is inserted into a bottom of the cigarette liquid cup 10. An outer edge of the ceramic liquid guiding wick 7 pierces through an inner wall of the cigarette liquid cup 10 to break the inner wall of the cigarette liquid cup 10, and cigarette liquid stored in the cigarette liquid cup 10 permeates into the ceramic liquid guiding wick 7. The ceramic liquid guiding wick 7 absorbs and stores the cigarette liquid therein. The atomizing heating piece 8 is adhered to the inner wall of the ceramic liquid guiding wick 7, and air from the air inlet 4 enters the interior of the atomizing wick. After the power supply of the atomizing wick is electrically connected to electrify the atomizing heating piece 8, the cigarette liquid stored in the ceramic liquid guiding wick 7 is heated and vaporized to produce smokes for users to inhale through the airflow passageway 12.

Described above is only used for explanation and description of a preferred embodiment of the present invention, and is not used to limit the present invention. Where those skilled in this art can make all sorts of other modifications, equivalent changes or improvements based on the above description in view of spirits and principles of the present invention, the modifications, changes or improvements are still covered within the inventive spirit of the present invention and the scope as defined in the following claims.

What is claimed is:

1. A ceramic atomizing wick, comprising a power supply positive terminal, a power supply negative terminal, and a fixing mount, an air inlet being disposed and opened at the power supply positive terminal along a direction from an outer wall surface of the power supply positive terminal toward an inner wall surface of the power supply positive terminal, wherein the power supply negative terminal is installed at a lower end of the power supply positive terminal, and an insulation ring is installed between an inner wall of the power supply positive terminal and an outer wall of the power supply negative terminal, a threaded hole is disposed and opened along an axial direction of the fixing mount, and a ceramic liquid guiding wick is partially installed in the threaded hole, an inner wall of the ceramic liquid guiding wick is in contact with an atomizing heating piece.

2. The ceramic atomizing wick as claimed in claim 1, wherein an outer threaded section is disposed at a lower end of an outer wall of the ceramic liquid guiding wick, and the outer threaded section is installed in the threaded hole of the fixing mount.

3. The ceramic atomizing wick as claimed in claim 2, wherein a sealing ring is installed between the fixing mount and the power supply positive terminal.

4. The ceramic atomizing wick as claimed in claim 3, wherein the atomizing heating piece is a heating wire, and the heating wire is bent into a spiral shape.

5. The ceramic atomizing wick as claimed in claim 3, wherein the atomizing heating piece is a metal heating film.

6. A cigarette cartridge, comprising a cigarette liquid cup, a liquid storage disposed inside the cigarette liquid cup, and an airflow passageway disposed and opened along an axial direction of the cigarette liquid cup, wherein the ceramic atomizing wick of claim 1 is installed in the cigarette liquid cup.

7. A cigarette cartridge, comprising a cigarette liquid cup, a liquid storage disposed inside the cigarette liquid cup, and an airflow passageway disposed and opened along an axial direction of the cigarette liquid cup, wherein the ceramic atomizing wick of claim 2 is installed in the cigarette liquid cup.

8. A cigarette cartridge, comprising a cigarette liquid cup, a liquid storage disposed inside the cigarette liquid cup, and an airflow passageway disposed and opened along an axial direction of the cigarette liquid cup, wherein the ceramic atomizing wick of claim 3 is installed in the cigarette liquid cup.

9. A cigarette cartridge, comprising a cigarette liquid cup, a liquid storage disposed inside the cigarette liquid cup, and an airflow passageway disposed and opened along an axial direction of the cigarette liquid cup, wherein the ceramic atomizing wick of claim 4 is installed in the cigarette liquid cup.

10. A cigarette cartridge, comprising a cigarette liquid cup, a liquid storage disposed inside the cigarette liquid cup, and an airflow passageway disposed and opened along an axial direction of the cigarette liquid cup, wherein the ceramic atomizing wick of claim 5 is installed in the cigarette liquid cup.

* * * * *